US008196376B2

(12) United States Patent
Uetsuki et al.

(10) Patent No.: US 8,196,376 B2
(45) Date of Patent: Jun. 12, 2012

(54) HEAT SHRINKING APPARATUS FOR SHRINK FILM

(75) Inventors: Akira Uetsuki, Osaka (JP); Koji Arima, Osaka (JP)

(73) Assignee: Fuji Seal International, Inc. (JP)

( * ) Notice: Subject to any disclaimer, the term of this patent is extended or adjusted under 35 U.S.C. 154(b) by 234 days.

(21) Appl. No.: 12/518,975

(22) PCT Filed: Dec. 5, 2007

(86) PCT No.: PCT/JP2007/001348

§ 371 (c)(1),
(2), (4) Date: Jun. 12, 2009

(87) PCT Pub. No.: WO2008/072366

PCT Pub. Date: Jun. 19, 2008

(65) Prior Publication Data

US 2010/0032077 A1 Feb. 11, 2010

(30) Foreign Application Priority Data

Dec. 15, 2006 (JP) ..... 2006-338425

(51) Int. Cl.
*B65B 53/02* (2006.01)

(52) U.S. Cl. ..... 53/557; 53/48.2; 53/442

(58) Field of Classification Search ..... 53/48.2, 53/442, 556, 557, 79, 509; *B65B 53/02, B65B 53/04*

See application file for complete search history.

(56) References Cited

U.S. PATENT DOCUMENTS 3,309,835 A * 3/1967 Peppler ..... 53/442
3,320,945 A * 5/1967 Dunkelman ..... 126/369
3,668,817 A * 6/1972 Bell ..... 53/397

(Continued)

FOREIGN PATENT DOCUMENTS

EP 0 708 023 A1 4/1996

(Continued)

OTHER PUBLICATIONS

International Search Report for International Application No. PCT/JP2007/001348 mailed Jan. 8, 2008 with English Translation.

*Primary Examiner* — Thanh Truong
(74) *Attorney, Agent, or Firm* — Cantor Colburn LLP

(57) ABSTRACT

A heat shrinking apparatus for a shrink film, which can uniformly heat shrink a shrink film covering a part of a whole of an article and can prevent adherence of water droplets on the surface of the article and the shrink film. The heat shrinking apparatus may include a heat treatment chamber installed so as to surround a transfer conveyor for transferring a bottle on which cylindrical label has been fitted, and heating means that heats the cylindrical label fitted on the bottle passing through the heat treatment chamber. The heat treatment chamber may include an external tunnel and an internal tunnel installed in a preheating zone, and an external tunnel and an internal tunnel installed in a main heating zone. The heating means includes preheating means that preliminarily heats and softens the cylindrical label fitted on the bottle passing through the interior of the internal tunnel, and main heating means that uses superheated steam to heat shrink the cylindrical label fitted on the bottle passing through the interior of the internal tunnel.

6 Claims, 8 Drawing Sheets

U.S. PATENT DOCUMENTS 3,678,244 A * 7/1972 Worline ..... 219/388
4,059,400 A * 11/1977 Heckman et al. ..... 432/124
4,738,082 A * 4/1988 Saitoh ..... 53/557
4,773,109 A * 9/1988 Reinehr et al. ..... 8/149.3
4,852,271 A * 8/1989 Heckman et al. ..... 34/105
5,400,570 A * 3/1995 Bennett ..... 53/442
5,403,635 A * 4/1995 Hoffman ..... 428/34.7
6,648,634 B2 * 11/2003 Nava ..... 432/121

FOREIGN PATENT DOCUMENTS

JP 61-115826 A 6/1986
JP 4-311434 A 11/1992
JP 9-272514 A 10/1997
JP 2003-54520 A 2/2003

* cited by examiner

HEAT SHRINKING APPARATUS FOR SHRINK FILM

CROSS REFERENCE TO RELATED APPLICATIONS

This is a U.S. national stage of application No. PCT/JP2007/001348, filed on 5 Dec. 2007. Priority under 35 U.S.C. §119(a) and 35 U.S.C. §365(b) is claimed from Japanese Application No. 2006-338425, filed 15 Dec. 2006, the disclosure of which is also incorporated herein by reference.

TECHNICAL FIELD

The present invention relates to a heat shrinking apparatus for a shrink film that heat shrinks a cylindrical label formed of a shrink film which is fitted on a container such as a PET bottle, a wrapping material formed of a shrink film which surrounds a container containing food, and so on.

BACKGROUND ART

A container such as a PET bottle which is filled with beverages such as soft drinks generally has a cylindrical label mounted thereon. The cylindrical label is often formed of a shrink film on which a brand name, information on the contents of the container, and the like are printed. Such a cylindrical label is generally fitted onto a container sequentially by a label mounting system including a transfer conveyor for transferring a container along a predetermined transfer passage, a label fitting apparatus for fitting an unshrunk cylindrical label onto the container which is being transferred by the transfer conveyor, and a heat shrinking apparatus for heat shrinking the cylindrical label fitted onto the container.

The heat shrinking apparatus installed in such a label mounting system includes a heat treatment chamber which is disposed so as to surround the transfer conveyor that transfers the container having the cylindrical label fitted thereon and a heating unit that heats the cylindrical label fitted on the container passing through the heat treatment chamber by hot air or saturated steam, and is adapted to heat shrink the cylindrical label while the container is passing through the heat treatment chamber.

Patent Document 1: JP 2003-54520 A

Patent Document 2: JP 09-272514 A

DISCLOSURE OF THE INVENTION

Problems to be Solved by the Invention

When heating a cylindrical label by hot air, a stream of forced air heated to 100° C. to 200° C. by a heater is directed locally onto the cylindrical label fitted onto a container. This results in a problem that uniform heat shrinking over the entire cylindrical label cannot be achieved, causing designs and characters printed on the cylindrical label to be deformed, impairing the quality of the completed label.

On the other hand, when the cylindrical label is heated by a saturated steam of heated air, the heat shrinking tends to be uniform over the entire cylindrical label, making it unlikely that the designs and characters printed on the cylindrical label will deform, making it possible to produce labels of uniform high quality. However, there arises a problem that with such a process, moisture adheres to the surface of the cylindrical label or the container, and that this moisture dampens cardboard boxes into which the containers are packed.

Further, cup containers storing pre-packaged foods such as instant noodles are generally subjected to "over shrink wrapping" in which the entire container is sealed in a shrink wrap. However, as the foods contained in such cups or containers cannot be exposed to moisture, it is not possible to perform heating using a saturated steam to heat shrink the shrink wrap surrounding the container, despite the advantages that deformation of designs and characters printed on the shrink film can likely be prevented. Similarly, when the container itself is made of paper or when a sealing lid made of a shrink wrap film is to be mounted on the mouth of a container to which a paper label is attached thereto, it is not possible to perform heating using saturated steam, in which water droplets will adhere to the container and so on.

It is therefore an advantage of the present invention to provide a heat shrinking apparatus for a shrink film, that can uniformly heat shrink a shrink film covering a part or a whole of an article and also can prevent water droplets from adhering onto the surface of the article or the shrink film.

In order to achieve the above advantage, a heat shrinking apparatus that heat shrinks a shrink film covering a part or a whole of an article according to claim 1 includes a heat treatment chamber that surrounds a transfer passage for the article, and heating means that heats the interior of the heat treatment chamber, wherein the heating means is adapted to supply superheated steam (steam generated by further heating saturated steam obtained by evaporation at 100° C. to a higher temperature) to the heat treatment chamber.

ADVANTAGEOUS EFFECTS OF THE INVENTION

As described above, with the heat shrinking apparatus for a shrink film according to claim 1 of the present invention, which is configured to heat shrink a shrink film covering a part or a whole of an article by superheated steam supplied to a heat treatment chamber, the advantage that designs and characters printed on the shrink film are less likely to be deformed can be achieved so that the film can be shrunk with precision, similar to the case of heating using saturated steam. Also, while saturated steam easily condenses to emit latent heat (enthalpy of vaporization), superheated steam only reduces its enthalpy and does not condense at all until the temperature thereof decreases to a saturation temperature. Accordingly, with heating by using superheated steam, contrary to the case of using saturated steam, it is possible to prevent moisture or water droplets from adhering to the surface of the shrink film or the article, which allows application of heating by superheated steam to packaged foods which cannot be exposed to moisture, containers made of paper, containers to which a paper label is attached, and so on.

Further, the superheated steam has the following characteristics:

(1) contrary to saturated steam whose supply temperature is 100° C., it is possible to set the supply temperature of superheated steam to 100° C. or higher as desired;

(2) because the heat capacity of superheated steam is greater than that of heated air, it is possible to heat a subject to be heated more rapidly than when the subject is heated by heated air at the same temperature; and (3) while heat is transferred by convection in the case of heated air, heat is transferred by convection, radiation, and condensation in a combined manner in the case of superheated steam. In addition, because heat transfer by convection in the case of superheated steam is 10 or more times as much as that in the case of heated air, the heating efficiency of superheated steam is considerably superior to that of heated air.

As such, by setting the supply temperature at which the superheated steam is supplied to the interior of the heat treatment chamber to a temperature which is significantly higher than about 100° C., which is a heat shrinkable temperature that allows various shrink films to be heat shrunk to the respective limit shrinkage ratios (see the graph showing heat shrinkage characteristics of shrink films [(an oriented polystyrene film (OPS), a high shrinkable polyethylene terephthalate film (high shrinkable PET), and a general polyethylene terephthalate film (general PET)] shown in FIG. 8), e.g. about 150 to 200° C., the shrink film covering an item which has entered the heat treatment chamber instantaneously heat shrinks to the limit shrinkage ratio. It is therefore possible to considerably shorten the time in which the film passes through the heat treatment chamber (i.e. passage time) compared to when the film is heated by hot air at the same temperature or when the film is heated by saturated steam. Consequently, the length of the heat treatment chamber can be shortened, which allows reduction in the space of the heat shrinking apparatus. Also, the amount of steam which must be supplied is less than the amount required when heating using saturated steam.

BRIEF DESCRIPTION OF THE DRAWINGS

These and other objects of the invention will be explained in the description below, in connection with the accompanying drawings, in which.

LIST OF NUMERAL REFERENCES

Figure 1:
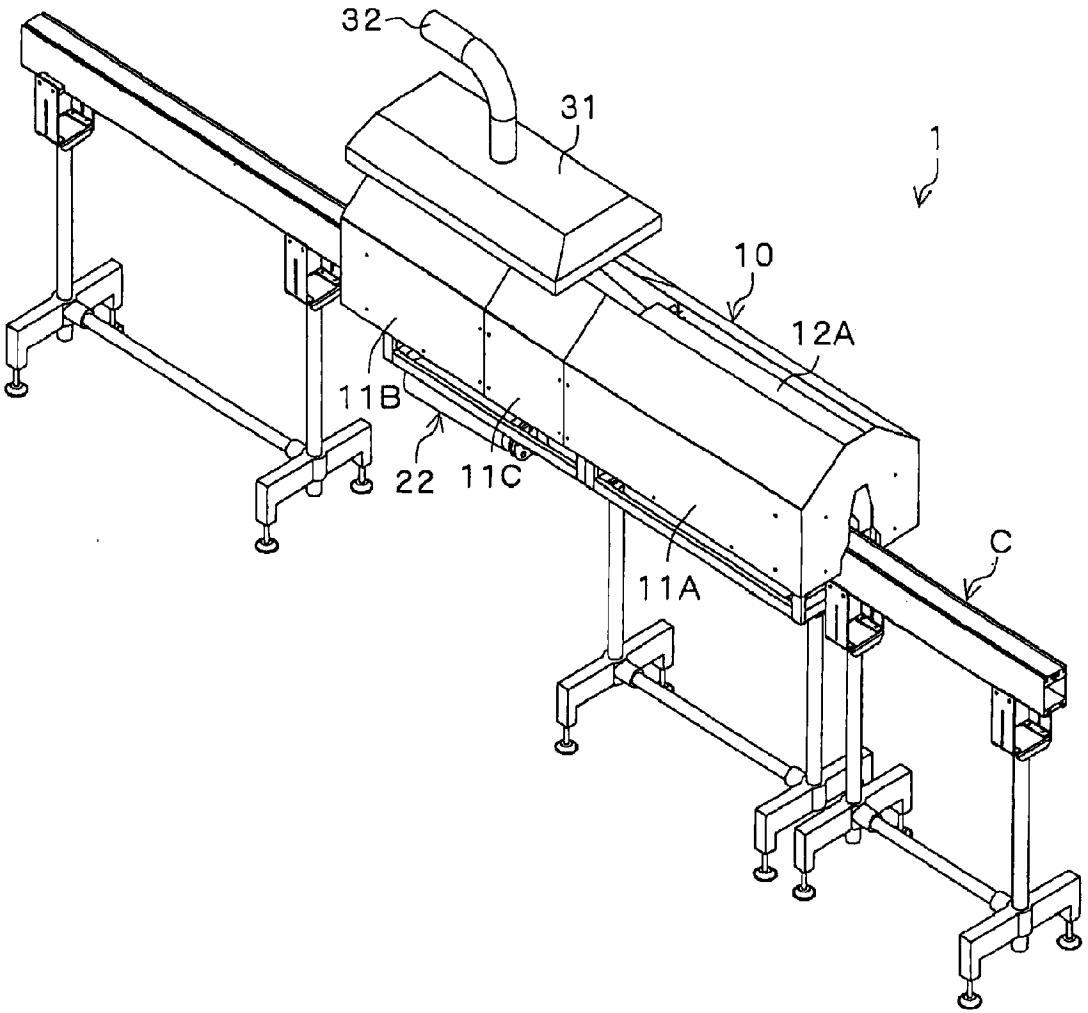
FIG. 1 is a perspective view illustrating a heat shrinking apparatus for a cylindrical label which is one embodiment of a heat shrinking apparatus for a shrink film according to the present embodiment.

1 heat shrinking apparatus
10 heat treatment chamber
11A, 11B, 11C external tunnel
12A, 12B, 12C internal tunnel
13A, 13B, 13C exhaust hole
21 preheating unit
22 main heating unit
23 superheated steam generating unit
24 steam supply tube
25 superheated steam supply head
26 side supply head
26*a* steam supply hole
27 lower supply head
27*a* steam supply hole
31 exhaust hood
32 exhaust duct
B PET bottle (article)
C transfer conveyor (transfer passage)
H hole
L cylindrical label (shrink film)
P plate
ZA preheating zone
ZB main heating zone
ZC coupling zone

BEST MODE FOR CARRYING OUT THE INVENTION

Figure 2:
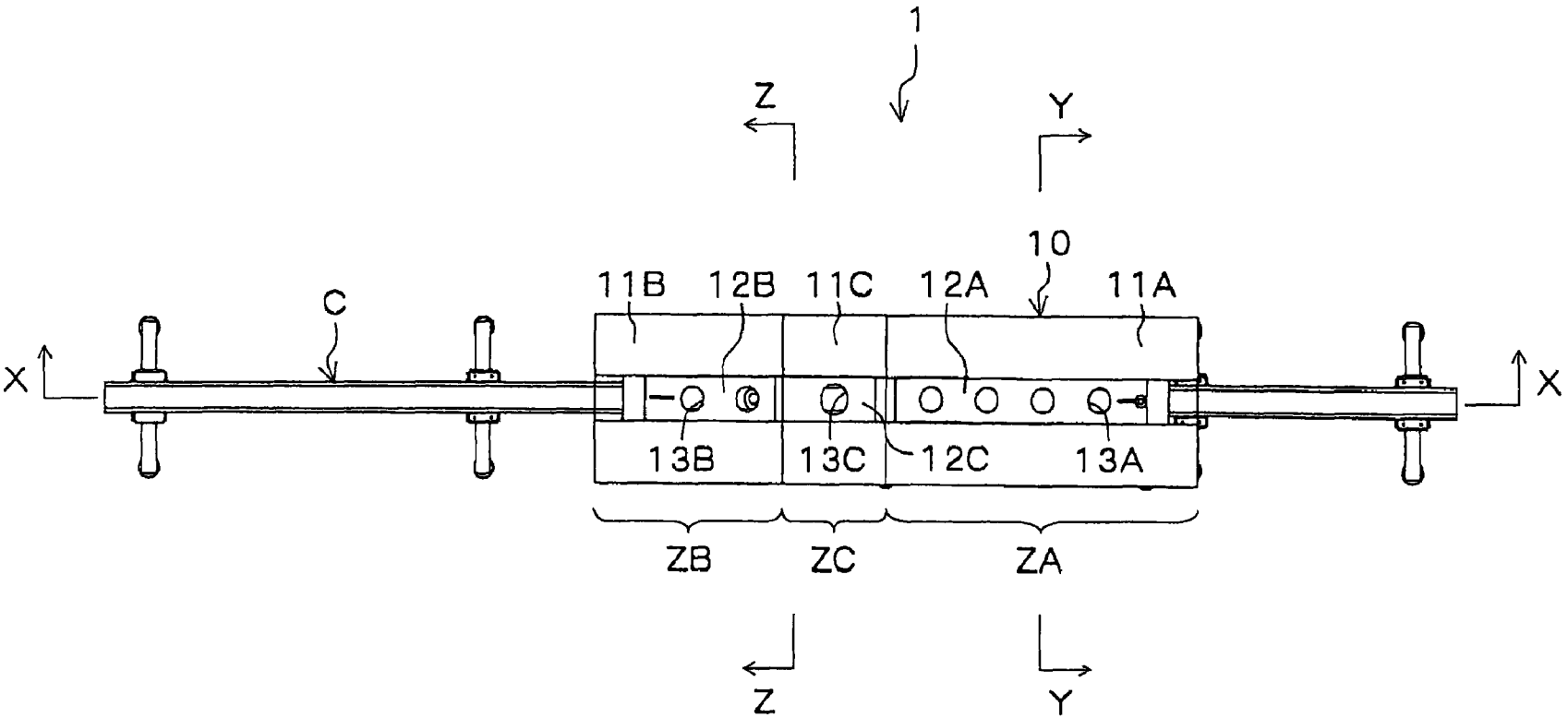
FIG. 2 is a plan view illustrating the heat shrinking apparatus described above.
Figure 3:
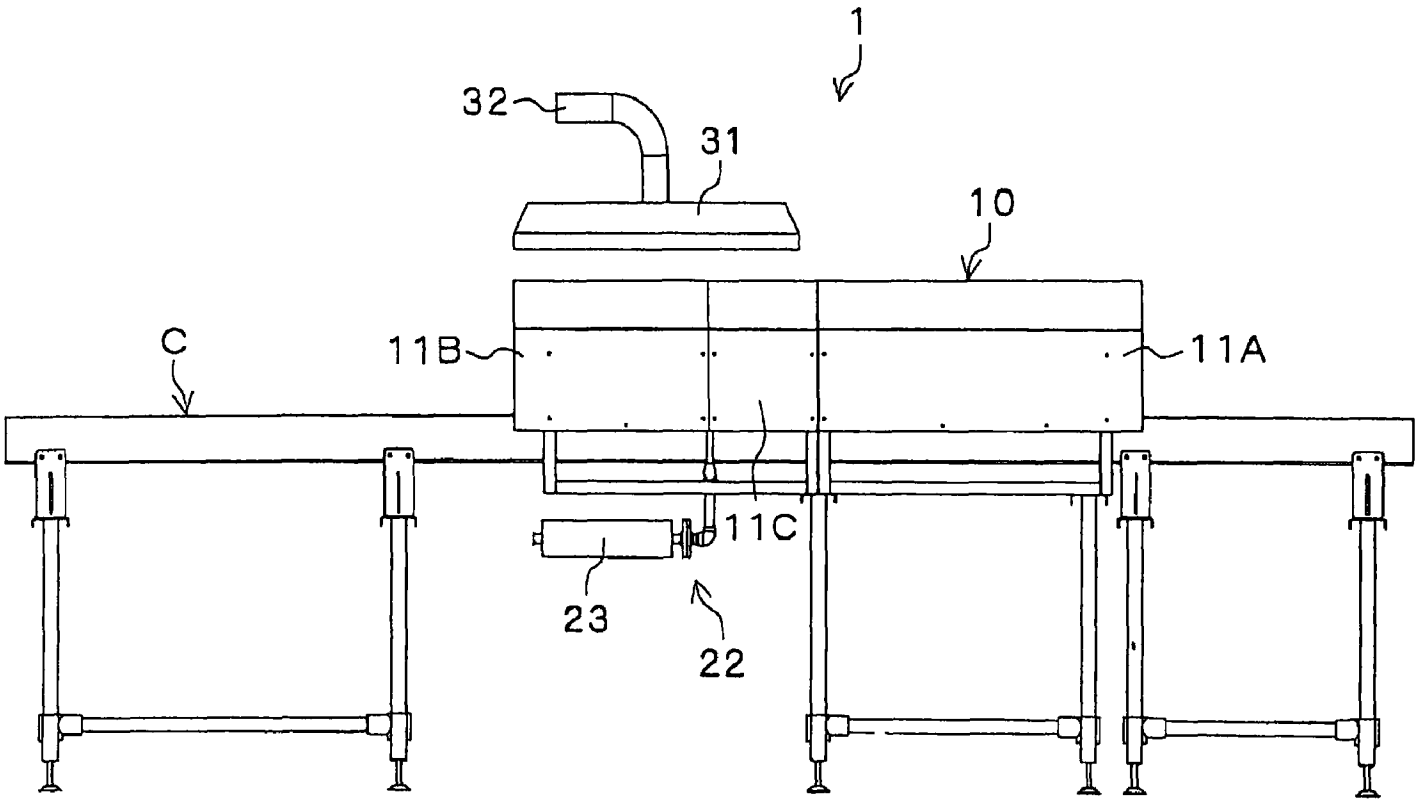
FIG. 3 is a side view illustrating the heat shrinking apparatus described above.

A preferred embodiment of the present invention will be described with reference to the drawings. FIGS. 1 to 3 illustrate a heat shrinking apparatus 1 for a cylindrical label, which is disposed in a label mounting line in which a cylindrical label formed of a shrink film is mounted onto a barrel portion of a PET bottle (hereinafter simply referred to as a "bottle") which is being transferred by a transfer conveyor C. The heat shrinking apparatus 1 is adapted to heat shrink an unshrunk cylindrical label, which has been fitted on the barrel portion of the bottle during the previous step, to cause the cylindrical label to closely adhere to the barrel portion of the bottle.

As illustrated in FIGS. 1 to 3, the heat shrinking apparatus 1 includes a heat treatment chamber 10 that is provided so as to surround the transfer conveyor C, and a heating unit that heats a cylindrical label fitted on the bottle passing through the heat treatment chamber 10, and is configured such that the cylindrical label fitted on the bottle is heat shrunk while the bottle is passing through the heat treatment chamber 10.

Figure 4:
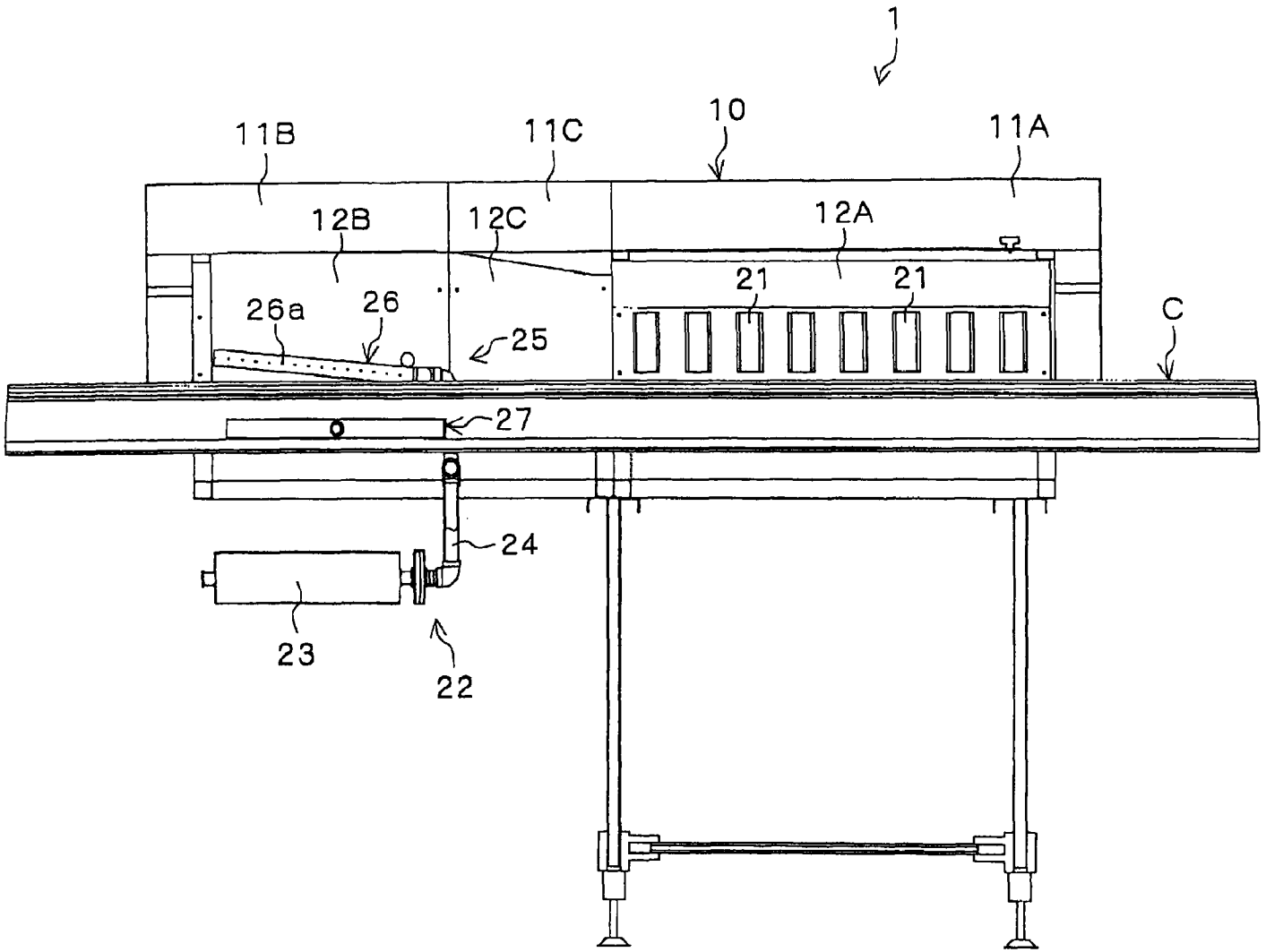
FIG. 4 is a cross sectional view taken along line X-X in FIG. 2.
Figure 5:
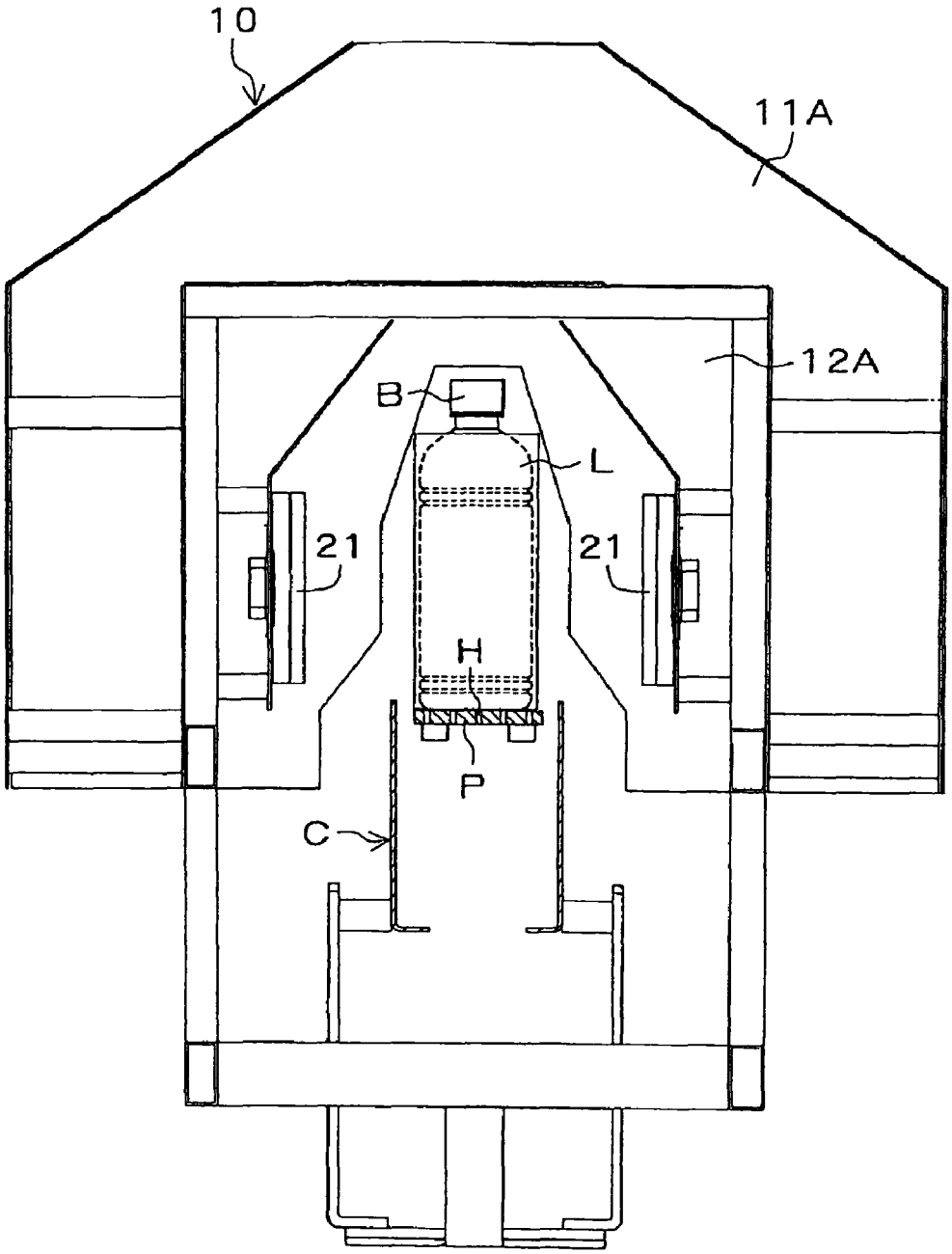
FIG. 5 is a cross sectional view taken along line Y-Y in FIG. 2.
Figure 6:
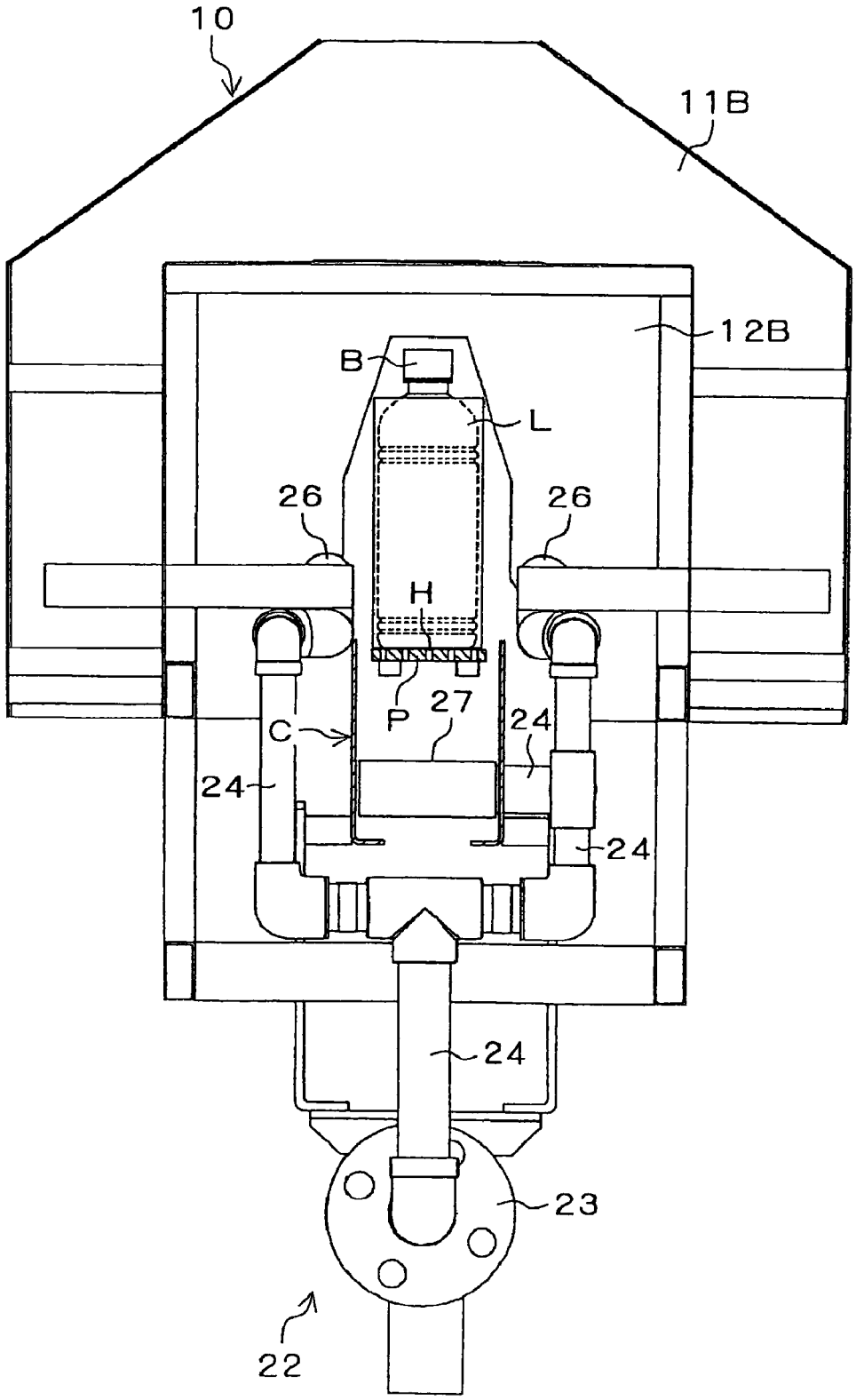
FIG. 6 is a cross sectional view taken along line Z-Z in FIG. 2.

As illustrated in FIGS. 4 to 6, the heat shrinking apparatus 10 includes a preheating zone ZA for preliminarily heating and softening the cylindrical label L fitted on the bottle B, a main heating zone ZB for heat shrinking the cylindrical label L to cause the cylindrical label L to be closely adhered to the bottle B, and a coupling zone ZC for coupling the preheating zone ZA and the main heating zone ZB. External tunnels 11A, 11B, 11C and internal tunnels 12A, 12B, 12C are provided in the preheating zone ZA, the main heating zone ZB, and the coupling zone ZC, respectively.

Further, the internal tunnels 12A, 12B, and 12C have exhaust holes 13A, 13B, and 13C formed on the respective upper surfaces, and upper surfaces of the external tunnels 11A, 11B, and 11C covering these internal tunnels 12A, 12B, and 12C are opened over the whole length thereof in the longitudinal direction.

The heating unit includes a preheating unit 21 that heats the cylindrical label L fitted on the bottle B passing through the interior of the internal tunnel 12A provided in the preheating zone ZA, and a main heating unit 22 that heats the cylindrical label L fitted on the bottle B passing through the interior of the internal tunnel 12B provided in the main heating zone ZB.

As illustrated in FIGS. 4 and 5, the preheating unit 21 is composed of a plurality of far-infrared heaters arranged opposing each other across the transfer conveyor C and is configured to heat the cylindrical label L fitted on the bottle B passing through the interior of the internal tunnel 12A to about 60° C. to 70° C. to thereby soften the cylindrical label L.

Here, the cylindrical label L is supplied as folded in a sheet form and is then unfolded for fitting onto the bottle B. As such, the cylindrical label L fitted on the bottle B attempts to restore its original planar shape by means of fold marks formed thereon. The preheating unit 21 preliminarily heats the cylindrical label L to eliminate these fold marks to shape the cylindrical label L into a substantially cylindrical shape.

Figure 7:
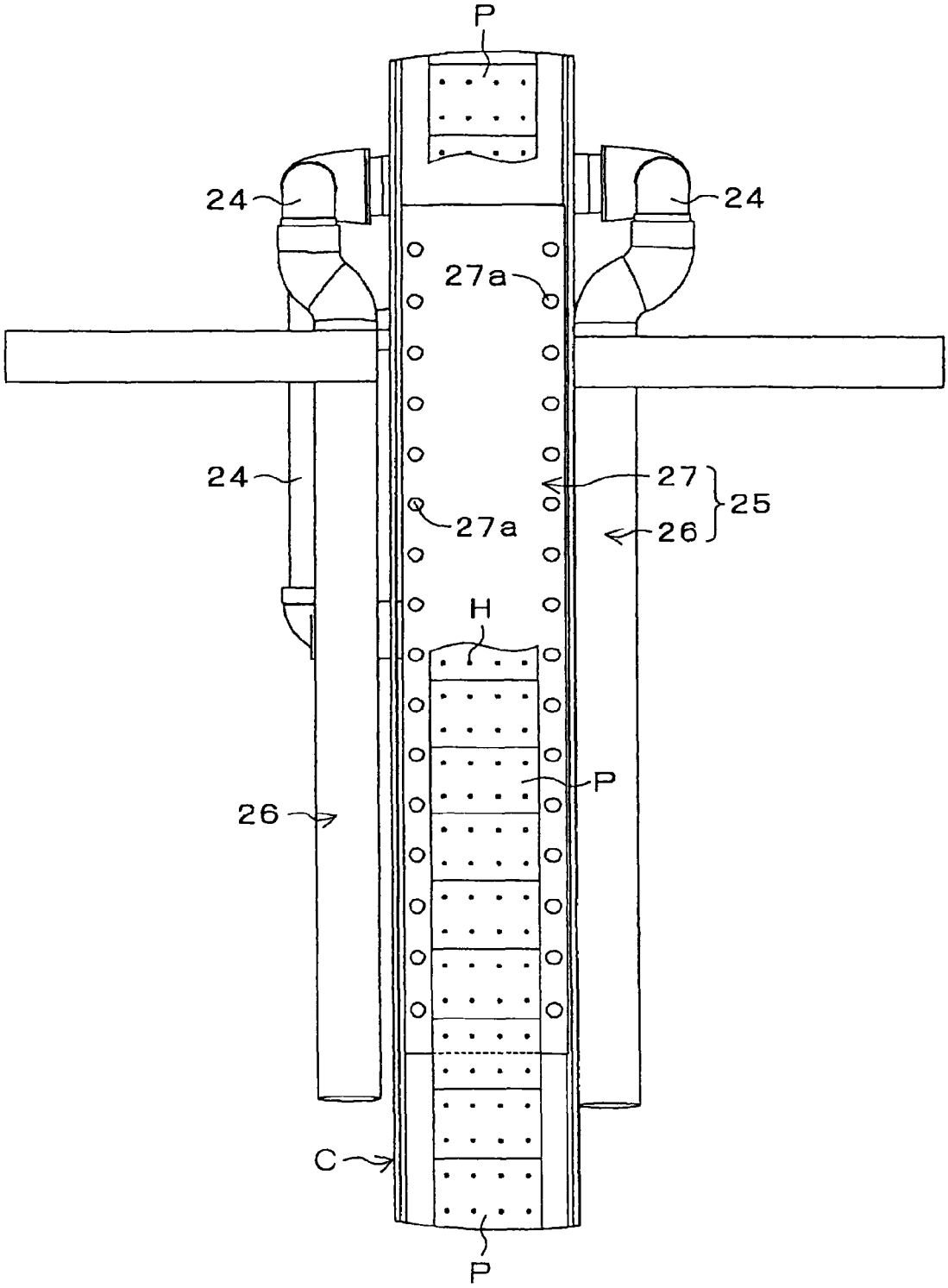
FIG. 7 is a plan view illustrating the interior of the internal tunnel in the main heating zone in the heat shrinking apparatus described above.
Figure 8:
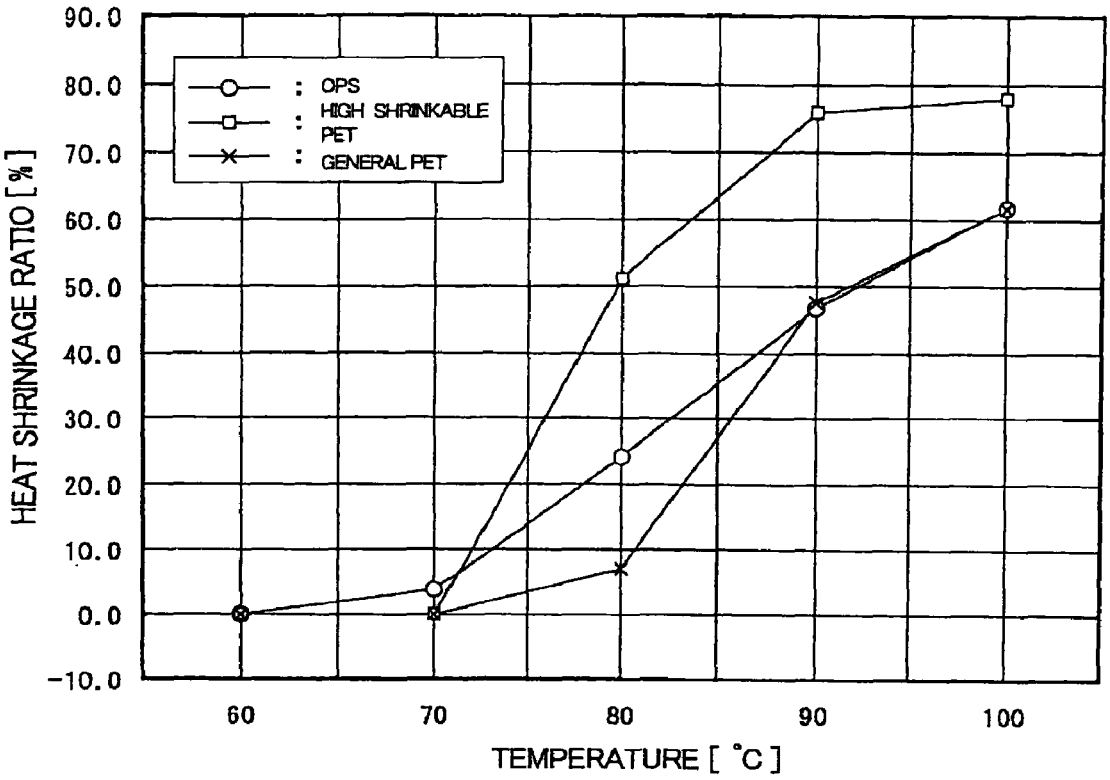
FIG. 8 is a graph showing heat shrinkage characteristics of shrink films.

As illustrated in FIGS. 4, 6, and 7, the main heating unit 22 includes a saturated steam generation unit (not shown) having a boiler that generates saturated steam, an electromagnetic induction heating type superheated steam generation unit 23 that generates superheated steam (normal pressure superheated steam) at a temperature of 150 to 180° C. by heating the saturated steam transferred from the saturated steam generation unit under normal pressure, a steam supply tube 24 that guides the superheated steam supplied from the superheated steam generation unit 23 into the internal tunnel 12B, and a superheated steam supply head 25 connected with the steam supply tube 24 and disposed within the internal tunnel 12B.

The superheated steam supply head 25 is composed of a pair of cylindrical side supply heads 26 disposed opposing each other with the transfer conveyor C interposed therebetween and a square-rod like lower supply head 27 disposed below a plate P of the transfer conveyor C on which the bottle B is placed. The side supply heads 26 and the lower supply head 27 extend from near the entrance port to near the exit port of the internal tunnel 12B.

The pair of side supply heads 26 are tilted such that approaching the exit side from the entrance side of the internal tunnel 12B each successive side supply head 26 is located at a gradually higher position. Each of the side supply heads 26 has a large number of steam supply holes 26a formed on the circumferential surface in such a manner that the steam supply holes on the respective side supply heads 26 are opposed to each other.

The lower supply head 27 has a large number of steam supply holes 27*a* formed on both outer edge sides of the upper surface thereof in the width direction of the plate P of the transfer conveyor C which is formed to have a smaller width than the width of the lower supply head 27. A large number of small holes H are also formed on the plate P of the transfer conveyor C.

Accordingly, the interior of the internal tunnel 12B is held at a temperature of 150 to 180° C. by the superheated steam from the steam supply holes 26*a* of the side supply heads 26 disposed on the both sides of the transfer conveyor C and the superheated steam from the steam supply holes 27*a* of the lower supply head 27 disposed below the transfer conveyor C.

Further, as illustrated in FIGS. 1 and 3, an exhaust hood 31 connected to an exhaust duct 32 is disposed above the external tunnel 11B so as to cover the main heating zone ZB, and the superheated steam supplied within the internal tunnel 12B is externally exhausted as necessary through an exhaust hole 13B, the upper surface opening in the external tunnel 11B, the exhaust hood 31, and the exhaust duct 32 so as to prevent the superheated steam supplied within the internal tunnel 12B from being excessively accumulated within the internal tunnel 12B.

In the heat shrinking apparatus 1 having the structure described above, the cylindrical label L fitted on the bottle B which has entered the heat treatment chamber 10 is first heated by the preheating unit (far infrared heaters) 21 while the bottle B is passing through the internal tunnel 12A disposed in the preheating zone ZA so that the label is softened and shaped into a substantially cylindrical shape, and then, while the bottle B is passing through the internal tunnel 12B disposed in the main heating zone ZB, the cylindrical label is heated by the superheated steam, so that the cylindrical label is heat shrunk and closely adhered to the barrel of the bottle B.

As described above, as the heat shrinking apparatus 1 is configured to heat shrink the cylindrical label L fitted on the bottle B by superheated steam within the internal tunnel 12B disposed in the main heating zone ZB, designs and characters printed on the cylindrical label L will unlikely deform, making it possible to produce labels of uniform high quality as in the case of heating by saturated steam.

Also, while saturated steam easily condenses to emit latent heat (enthalpy of vaporization), superheated steam only reduces its enthalpy and does not condense until the temperature thereof decreases to a saturation temperature. Accordingly, with heating by using superheated steam, it is possible, contrary to when using saturated steam, to prevent water droplets from forming on the surface of the cylindrical label L or the bottle B.

Also contrary to when saturated steam is used, the temperature of the superheated steam supplied to the internal tunnel 12B is 150 to 180° C., which is significantly higher than about 100° C. that is a heat shrinkable temperature which allows various shrink films to be heat shrunk to the respective limit shrinkage ratios. Further, because the heat capacity of superheated steam is greater than that of heated air, it is possible to heat the cylindrical label L more rapidly than when the cylindrical label L is heated by heated air at the same temperature. Also, while heat is transferred only by convection in the case of heated air, heat is transferred by convection, radiation, and condensation in a combination manner in the case of superheated steam. In addition, because the heat transfer by convection of superheated steam is 10 or more times as much as that in the case of heated air, the heating efficiency of superheated steam is considerably superior to that of heated air. Consequently, the cylindrical label L fitted on the bottle B which has entered the internal tunnel 12B instantaneously heat shrinks to the limit shrinkage ratio.

Accordingly, compared to when heating by hot air at the same temperature or when heating by saturated steam, the time in which the bottle passes through the main heating zone ZB (the internal tunnel 12B) can be considerably shortened, so that the length of the main heating zone ZB (the internal tunnel 12B) can be shortened, to thereby allow reduction in the space required for the whole apparatus.

While in the above described example the heat shrinking apparatus was described using an example of mounting a cylindrical label formed of a shrink film onto a PET bottle, the heat shrinking apparatus of the present invention is obviously applicable in any case of heat shrinking a shrink film covering a part or a whole of an article, such as fitting a cylindrical label formed of a shrink film on a barrel portion of a cup container, mounting a sealing lid formed of a shrink film onto the mouth of a container, and so on.

Here, the heat shrinking apparatus of the present invention, in which a shrink film instantaneously heat shrinks when the main heating by using superheated steam is performed in the main heating zone, has the following problem. Specifically, when mounting a cylindrical label on a cup-shape container having a tapered barrel portion, the cylindrical label rides up toward the smaller diameter side of the cup-shape container at the time of heat shrinking, leading to a possibility that the cylindrical label cannot be reliably mounted at a predetermined position of the container. In such a case, it is desirable to intensively preheat a portion of the cylindrical label fitted on the cup-shape container corresponding to a larger diameter portion of the cup-shape container in the internal tunnel disposed in the preheating zone to locally heat shrink that portion of the cylindrical label and thus temporarily fix (align) the cylindrical label on the barrel portion of the container prior to the main heating using superheated steam.

Further, when applying the over shrink wrapping to cup containers containing foods such as instant noodles which should not be exposed to moisture, when the container itself is made of paper, and when mounting a cap seal formed of a shrink film onto a spout of a container to which a paper label is attached, conventionally it has not been possible to perform heating using saturated steam in which water droplets adhere to the container and so on, and therefore the only heretofore practical option has been to employ heating by hot air, which has made obtaining uniform, high-quality labels problematic. However, as described above, with the heat shrinking apparatus of the present invention which heat shrinks a shrink film using superheated steam while preventing moisture formation, it is possible to apply the over shrink wrapping appropriately to foods contained in cup containers which must avoid moisture, and so on.

Further, while in the above example, the main heating is performed using superheated steam having a temperature of 150 to 180° C., the temperature of the superheated steam is not limited to this example and may be set anywhere within a range of between 120° C. and 300° C. as required, in accordance with the passage rate in the main heating zone (i.e. passage time through the main heating zone).

Also, while in the above example, far infrared heaters are employed as the preheating unit 21, the preheating unit 21 is not limited to this example, and a hot-blast heater, a near infrared heater, a halogen lamp, and so on can also be employed.

Further, while an electromagnetic induction heating type superheated steam generation unit 23 is described in the above example, the superheated steam generation unit is not limited to this type, and various heating types can be employed.

In addition, while in the above example, the main heating is performed by using normal pressure superheated steam, the main heating is not limited to this example and can be similarly performed by using high pressure superheated steam.

Moreover, while in the above example, the preliminary heating is performed prior to performing the main heating using superheated steam, the present invention is not limited to this example, and the preliminary heating may be omitted when unnecessary. In such a case, it is not necessary to provide the preheating zone ZA including the external tunnel 11A, the internal tunnel 12A, and the preheating unit 21.

INDUSTRIAL APPLICABILITY

As described above, the heat shrinking apparatus for a shrink film according to the present invention can uniformly heat shrink a shrink film covering a part or a whole of an article and is therefore useful for suppressing deformation of designs and characters printed on the shrink film such that they will be accurately rendered in the final product. In addition, the heat shrinking apparatus of the present invention may be suitably applied to food contained in cups which must avoid moisture, paper containers, containers having a paper label attached thereto, and so on, because adherence of moisture to a surface of the article or shrink film can be prevented. Further, the heat shrinking apparatus for a shrink film according to the present invention can instantaneously heat shrink a shrink film covering an article which has entered the heat treatment chamber using superheated steam to a limit shrinkage ratio, so that the passage time through the heat treatment chamber can be considerably shortened compared to when hot air at the same temperature or saturated steam are used for heating. Accordingly, with the heat shrinking apparatus of the present invention, the length of the heat treatment chamber can be reduced, to thereby allow reduction in the space required for the apparatus. Also, compared to the case of heating using saturated steam, the amount of steam that must be supplied can also be reduced.

The invention claimed is:

1. A heat shrinking apparatus for a shrink film, that heat shrinks a shrink film covering a part or a whole of an article, the heat shrinking apparatus comprising:

a heat treatment chamber that surrounds a transfer passage for the article; and heating means that heats the interior of the heat treatment chamber;

wherein the heating means is adapted to supply superheated steam to the heat treatment chamber;

the heating means includes a pair of side supply heads disposed opposing each other with a transfer conveyor, on which the article is placed, being interposed therebetween each of the pair of side supply heads forms a cylindrical shape, wherein a plurality of steam supply holes are formed on a circumferential surface of the cylindrical shape to be opposed to each other, and the superheated steam is supplied through the steam supply holes; and the pair of side supply heads are respectively tilted such that approaching an exit side from an entrance side of the heat treatment chamber each successive side supply head is located at a gradually higher position.

2. The heat shrinking apparatus according to claim 1, wherein the heat treatment chamber includes a preheating chamber and a main heating chamber, the superheated steam is supplied to an interior of the main heating chamber, and the preheating chamber includes preheating means, the preheating means intensively heating a portion of the article having a tapered barrel portion, that corresponds to a larger diameter portion of the article.

3. The heat shrinking apparatus according to claim 2, wherein the temperature of the superheated steam is between 150° C. and 180° C., and the preheating means heats the portion of the article at the temperature between 60° C. and 70° C.

4. The heat shrinking apparatus according to claim 2, wherein the preheating means is of a heating type different from a heating type employed in the main heating chamber, and is composed of one of a far infrared heater, a near infrared heater, a halogen lamp, and a hot-blast heater.

5. The heat shrinking apparatus according to claim 2, wherein the preheating chamber and the main heating chamber respectively are composed of a combination of internal tunnels and external tunnels, and are configured such that the superheated steam is externally exhausted through an exhaust hood provided in an upper surface opening of an external tunnel that corresponds to the main heating chamber.

6. The heat shrinking apparatus according to claim 1, wherein the heating means includes an electromagnetic induction heating type superheated steam generation unit that generates the superheated steam.

* * * * *